US008348259B2

(12) United States Patent
Marasco et al.

(10) Patent No.: US 8,348,259 B2
(45) Date of Patent: Jan. 8, 2013

(54) SENSORS AND VARIABLE POSITIONED LIFT PLATES FOR LAMINATED STOCKS IN PAPER TRAYS WITH A TOP VACUUM FEEDER

(75) Inventors: Joseph Marasco, Fairport, NY (US); Brian C. Cyr, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 502 days.

(21) Appl. No.: 12/190,134

(22) Filed: Aug. 12, 2008

(65) Prior Publication Data

US 2010/0038843 A1 Feb. 18, 2010

(51) Int. Cl.
*B65H 1/08* (2006.01)
*B65H 1/18* (2006.01)

(52) U.S. Cl. ..... 271/148; 271/152

(58) Field of Classification Search ..... 271/145, 271/148, 152, 147
See application file for complete search history.

(56) References Cited

U.S. PATENT DOCUMENTS

| | | | | | |
|---|---|---|---|---|---|
| 1,685,799 | A * | 10/1928 | Baker | 271/148 |
| 2,886,314 | A * | 5/1959 | Phelan | 271/148 |
| 3,768,805 | A * | 10/1973 | Kuksa | 271/126 |
| 5,346,203 | A | 9/1994 | Stemmle | |
| 5,459,548 | A * | 10/1995 | Matsuda et al. | 355/72 |
| 6,260,842 | B1 * | 7/2001 | Nelson et al. | 271/145 |
| 6,283,469 | B1 * | 9/2001 | Weber | 271/148 |
| 6,845,977 | B2 | 1/2005 | Leveto et al. | |
| 6,848,688 | B1 | 2/2005 | Ruthenberg et al. | |
| 7,464,925 | B2 * | 12/2008 | Dobbertin et al. | 271/148 |
| 7,669,846 | B1 * | 3/2010 | Hoover et al. | 271/148 |
| 2003/0102623 | A1 * | 6/2003 | Hirai et al. | 271/145 |
| 2006/0244199 | A1 | 11/2006 | Marasco | |
| 2006/0284366 | A1 | 12/2006 | Van Dungen et al. | |
| 2007/0013121 | A1 * | 1/2007 | Kang et al. | 271/9.01 |
| 2007/0257419 | A1 | 11/2007 | Wilcox et al. | |
| 2007/0280768 | A1 | 12/2007 | Allwright | |
| 2009/0072470 | A1 * | 3/2009 | Marasco | 271/146 |
| 2009/0115122 | A1 * | 5/2009 | Roth et al. | 271/165 |

* cited by examiner

*Primary Examiner* — Patrick Cicchino
(74) *Attorney, Agent, or Firm* — Oliff & Berridge, PLC

(57) ABSTRACT

An apparatus, method and system for a feeding a sheet in a document reproduction machine. A feedbox is contained within a document reproduction machine. Within the feedbox, an elevator moves at least one sheet to the upper portion of the feedbox, to a stack height finger, for feeding the sheet into a feed device. At least one sensor, located at the upper portion of the feedbox, detects the location of the sheet. The location information is sent from the sensor to a data processing device. The data processing device sends information to an actuating device. The actuating device may cause one or more plungers to move through apertures in the elevator. The plungers will result in a substantially flat sheet. The sheet is then fed into the feed device.

16 Claims, 10 Drawing Sheets

SENSORS AND VARIABLE POSITIONED LIFT PLATES FOR LAMINATED STOCKS IN PAPER TRAYS WITH A TOP VACUUM FEEDER

BACKGROUND

This disclosure relates to a sheet feed apparatus for use inside a document reproduction machine.

A sheet feeding apparatus is used in scanners, copiers, printers and the like. A sheet feeding apparatus contained inside a reproduction machine may include a feed box, elevator tray, stack height sensor and a feed device.

The feed box may include a lead side and a trail edge. The trail edge may be adjustable and allows for different size sheets. The sheets are positioned on an elevator that moves vertically inside the feed box to carry the sheets to the feed device. A stack height finger is located at or near the top of the feed box. When the elevator has reached the stack height finger, a sensor attached to the stack height finger instructs the elevator to stop moving. The feed device is then actuated to receive the sheet for feeding into the document reproduction device.

Feeding problems occur when using media made of various paper materials, Mylar paper, laminated paper, Xerox DocuCards, and medical forms. Some media stack in a manner such that the sheets are not substantially flat. The curvature of a topmost sheet may result in the sheet being improperly fed into the feed device.

SUMMARY

It would be advantageous to provide an apparatus, method and system of feeding paper into a feed device so as to ensure that a sheet fed to a feed device is substantially flat so as to accommodate proper feeding.

To address or accomplish these advantages, as described below, and/or other advantages, exemplary embodiments may include a sheet feeding apparatus. Exemplary embodiments may include a feed box, which may be contained within a document reproduction machine, an elevator tray within the feed box that can move vertically to carry sheets to an upper portion of the feedbox, a plurality of sensors located in the upper portion of the feed box, a data processing device located within the document reproduction machine, an actuating device located below the elevator tray, a plurality of plungers, and a feed device for receiving sheets.

The sheet feeding apparatus may include a feed box, which may be contained within a document reproduction machine, an elevator tray within the feed box that can move vertically, a plurality of sensors located in the upper portion of the feed box, a data processing device located within the document reproduction machine, an actuating device located below the elevator tray, a plurality of plungers, and a feed device. More specifically, exemplary embodiments may include multiple plungers that can be actuated to adjust the height of a sheet so that the lead edge, trail edge, front edge, and rear edge of the sheet are the same height when being fed into the feed device.

The sheet feeding apparatus may include a feed box, which may be contained within a document reproduction machine, an elevator tray within the feed box that can move vertically to carry sheets to an upper portion of the feedbox, a plurality of sensors located in the upper portion of the feed box, a data processing device located within the document reproduction machine, an actuating device located below the elevator tray, a plurality of plungers, and a feed device for receiving sheets.

More specifically, an exemplary embodiment may include a plate that can be actuated to adjust the height of a sheet so that the lead edge, trail edge, front edge, and rear edge of the sheet are the same height when being fed into the feed device.

Exemplary embodiments are described herein with respect to architectures for document reproduction machines. However, it is envisioned that any imaging device that may incorporate the features of the document reproduction machine described herein are encompassed by the scope of the spirit of the exemplary embodiments.

DETAILED DESCRIPTION OF THE EMBODIMENTS

Figure 1:
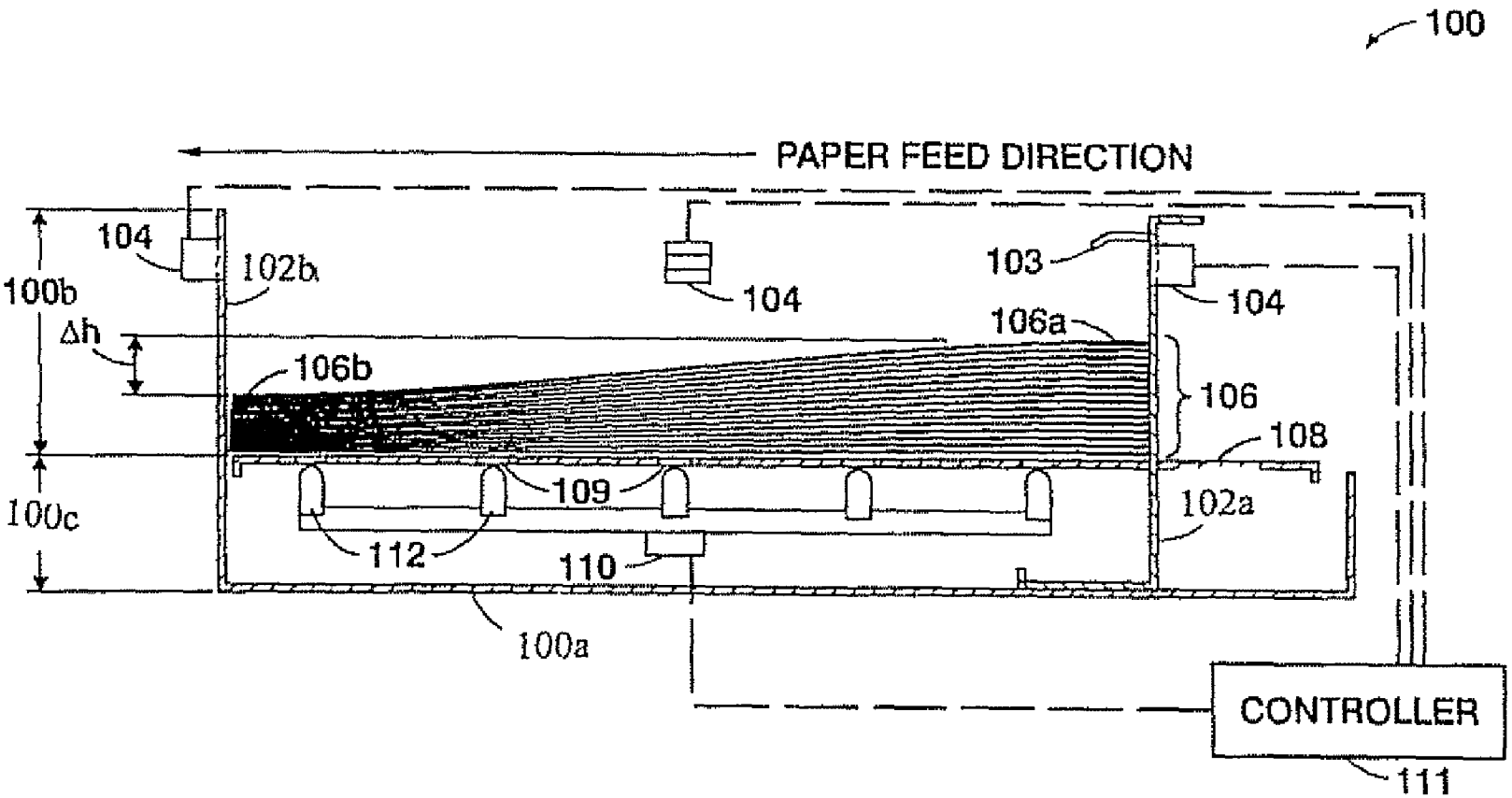
FIG. 1 is a side view of a sheet feed apparatus in a document reproduction machine of an exemplary embodiment.

The exemplary embodiments are intended to cover all alternatives, modifications and equivalents as may be included within the spirit and scope of the devices, methods and systems as defined herein.

For an understanding of the apparatus, method and system for sheet feeding, reference is made to the drawings. In the drawings, like reference numerals have been used throughout to designate similar or identical elements. The drawings depict various embodiments of illustrative sheet feed machines incorporating the features of the exemplary embodiments therein. As shown, the drawings schematically depict the various components of a sheet feeding machine that has the various features. In as much as the art of sheet feeding in a document reproduction machine is well known, the various parts employed in the sheet feeding apparatus will be schematically shown herein and their operation described with reference thereto.

Referring to FIG. 1, one embodiment of a sheet feed apparatus may include a feed box 100 having a bottom 100*a*, an upper portion 100*b*, a lower portion 100*c*, an trail guide 102*a*, a lead edge guide 102*b*, a front guide 102*c* (not shown), a rear guide 102*d* (not shown), a stack height finger 103, a plurality of sensors 104, a sheet 106 having a trail edge of sheet 106*a*, a lead edge of sheet 106*b*, a front edge of sheet 106*c* (not shown), a rear edge of sheet 106*d* (not shown). Due to stacking of sheets 106, there may be a height difference, $\Delta h$, between any of the trail edge of sheet 106*a*, the lead edge sheet 106*b*, the front edge of sheet 106*c*, or the rear edge of sheet 106*d*. An exemplary embodiment may further include an elevator 108, apertures 109 defined by elevator 108, an actuating device 110, a data processing device 111, plungers 112, and a feed device 101.

The trail edge guide 102*a* of feed box 100 may be an adjustable side of the feed box 100, which may accommodate a sheet 106 of different sizes. A sheet 106 may be various print media sheets, of various sizes and weights. Sheets 106 may be thin, flexible or even flimsy paper and sometimes even plastic, such as overhead transparencies. The trail edge guide 102*a* may be used to maintain the sheet 106 in proper orientation for feeding sheet 106 into the feed device 101 (not shown).

The feed device 101 may be located above the feed box 100. Alternatively, the feed device 101 may be located above the upper portion 100*b* of the feed box 100. The feed device 101 may be a vacuum feed device, roller system or any known or later developed device that can receive a sheet 106. The feed device 101 may take the sheet to be processed within the document reproduction machine. The feed device 101 may utilize positive air flow over a top sheet of a plurality of sheets 106, and air flow between the sheets 106, to separate the top sheet 106 from the underlying sheets 106, whereby, only the top sheet 106 is captured for feeding. In an exemplary embodiment, a plenum may define an opening that is substantially parallel to the bottom; the plenum may accommodate retrieval of the top sheet 106.

The stack height finger 103 may be attached to the upper portion 100*b* of the inner side of the feed box 100. The stack height finger 103 may provide a downward pressure, even if only slight, to the trail edge 106*a* of the sheet 106 to permit air to be injected between the sheets. The stack height finger 103 controls the elevator 108 in the feed box 100 to properly position a sheet 106 for capture by the feed device 101. The stack height finger 103 senses the height of the sheet 106 by engaging the top surface near the trailing edge of the top sheet 106. The stack height finger 103 causes activation of the elevator 108 to position the top sheet 106 near the feed device 101.

The plurality of sensors 104 may be located in the upper portion 100*b* of the feed box 100. The sensors 104 may be located below the stack height finger 103. Each sensor 104 must be of the same height from the bottom 100*a* of the feed box 100. The sensors 104 may be optical or any known or later developed device that can sense a sheet used in a document reproduction machine. The sensor 104 may include photodetectors, semiconductor device such as photocells, photodiodes, photo-transistors, LCDs, and image sensors. A short path optical interception device may be used as a sensor 104. Also, a laser detection system may be used as a sensor 104. One or more sensors 104 may be used to determine if a sheet is substantially flat. The determination information may then be transmitted to a data processing device 111.

One or more sheets 106 may be located inside the feed box 100. The sheets 106 are placed on top of an elevator 108. A sheet 106 has a trail edge 106*a* and a lead edge 106*b*, a front edge 106*c*, and a rear edge 106*d*. The elevator 108 is located inside the feed box 100. The elevator 108 may be arranged to move vertically within the feed box 100. The elevator 108 may be cast from a metallic, plastic or other now known or later developed material. The elevator 108 may be actuated by a motor that receives information from a data processing device that may be the same as the data processing device 111 or another data processing device. The elevator 108 may move vertically towards the upper portion 100*b* of feedbox 100 according to the amount of sheets 106 in the elevator 108, so as to supply sheets 106 to feed device 101. Each time a sheet 106 is fed into the feed device 101, the amount of sheets 106 decreases, and the elevator 108 may be actuated to move upwards. When the feed box 100 has no sheets 106 remaining, then the elevator 108 may be arranged to return to its lowest position in the lower portion 100*c* of the feed box 100.

Figure 10:
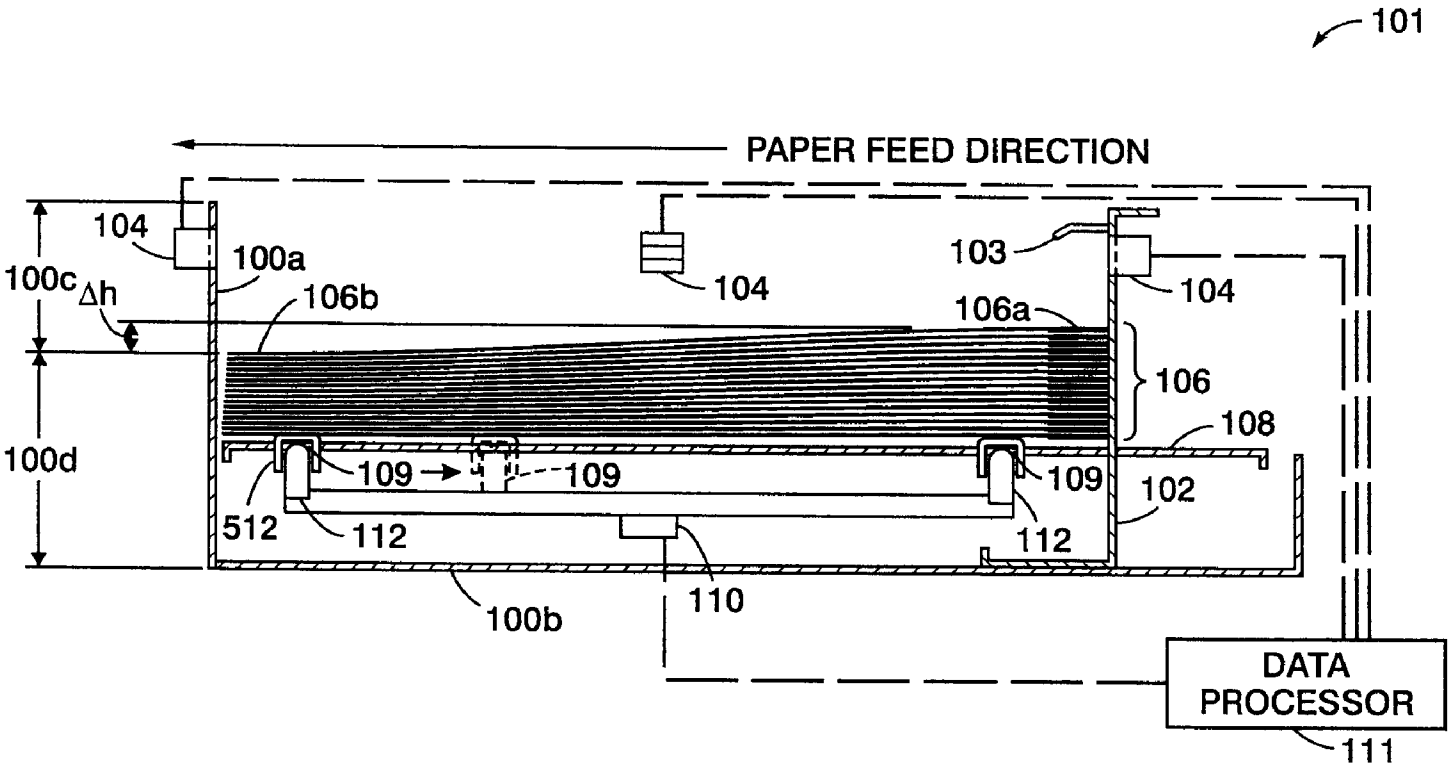
FIG. 10 is a side view of an elevator of a sheet feed apparatus in a document reproduction machine of an exemplary embodiment.

In one embodiment, the elevator 108 may define one or more apertures 109. The apertures 109 may be of any shape. For example, the apertures 109 may be of any shape including circular, oval, square, triangular, or irregular shape. The apertures 109 may be adjustable in size. In another embodiment, the elevator 108 may include internal sliding parts that increase or decrease the size of the aperture 109. For example, the internal sliding parts may close an aperture 109, when the elevator 108 does not contain any sheets 106. When the elevator 108 returns to its lowest position in the lower portion 100*d* of the feedbox 100, there should be sufficient space for the actuating device 110, plungers 112, and possibly the data processing device 111 connections thereto. FIG. 10 depicts an elevator with adjustable apertures.

As a portion of the sheet 106 passes a sensor 104, a sensor 104 will send information, e.g., the presence of the sheet or irregular position of the sheet, to a data processing device 111. The data processing device 111 processes and transmits information to an actuating device 110. The data processing device 111 may be a computer system, or constitute any known or later-developed device that can process and transmit information from a sensor. The data processing device 111 may include an input portion, a processing portion, storage portion and an output portion. The data processing device 111 may be hardware located inside or outside the document reproduction machine. Another alternative embodiment may include a data processing device having a software code compiler in combination with a computer hardware device.

The data processing device 111, according to information received from the sensors 104, determines how the actuating device 110 will function so that a sheet 106 is maintained in a substantially flat arrangement. The actuating device 110 will substantially reduce the height difference, $\Delta h$, between either the trail edge of sheet 106*a*, the lead edge of sheet 106*b*, the front edge of sheet 106*c*, or the rear edge of sheet 106*d*. For example, if the sensors 104 indicate that the sheet is substantially flat, the data processing device 111 will provide information to the actuating device 110 directing the actuating device 110 not to act. Alternatively, the data processing device may be configured to send no output to the actuating device 111, thereby passively preventing the actuating device 110 from acting.

The data processing device 111 may be configured in a system architecture as one or more computers, database computers, and interfaces. A computer may include at least one processor and memory coupled to a bus. The bus may be one or more of any suitable bus structures, including a memory bus or memory controller, peripheral bus, and a processor or local bus using any of a variety of bus protocols. The memory may include RAM, ROM, Flash, optical, DVD, magneto-optical. A network interface may be coupled to the bus to provide an interface to the data communication network for exchange of data among various devices. Also, the data processing device 111 may be of varying memory size and computing speed. The data processing device 111 may be located inside the document reproduction machine.

The actuating device 110 may be located between the elevator 108 and the bottom of the feed box 100. The actuating device 110 may be a rotary cam or motor device or any known or later designed device that can actuate a plunger 112. The actuating device 110 receives information from the data processing device 111. The information received by the actuating device 110 determines how one or more plungers 112 will function. For example, the information may indicate that a topmost sheet 106 is not substantially flat so as to accommodate proper receipt by feed device 101. If so, the actuating device 110 may then act on plungers 112 to effect application of pressure at varying points of the stack of sheets 106 so as to cause the topmost sheet 106 to be substantially flat thereby causing Δh to equal about zero. The actuating device 110 and the plungers 112 may be connected to the elevator 108. As the elevator 108 moves vertically in a direction, the actuating device 110 and the plungers 112 may also be arranged to move with the elevator 108 in the same direction.

The actuating device 110 may be a device that rotates in varying increments according to information received from the data processing device 111. The rotation may occur by a shaft or other means. In an exemplary embodiment, the actuating device may have cams attached to the shaft for different plungers 112. Alternatively, the actuating device 110 may have one shaft for one cam system that operates a plunger 112. The actuating device may be a part of the plunger 112. Each actuating device may receive information from a data processing device 111, and act upon sheets 106 accordingly. The actuating device may receive information directly from the sensors 104. The sensors 104 may send information directly to the actuating device 110, where the actuating device 110 may also include a device for processing information from the sensors 104.

In yet another exemplary embodiment, the actuating device may also be a stepper motor apparatus. The stepper motor may involve open looped or closed looped communication, bipolar or unipolar. The stepper motor may be a L/R drive circuit or a chopper drive circuit. Alternatively, the actuating device may be a hydraulic or pneumatic apparatus. The actuating device 110 may be a plurality of elevators that may vertically move a plunger 112.

Figure 2:
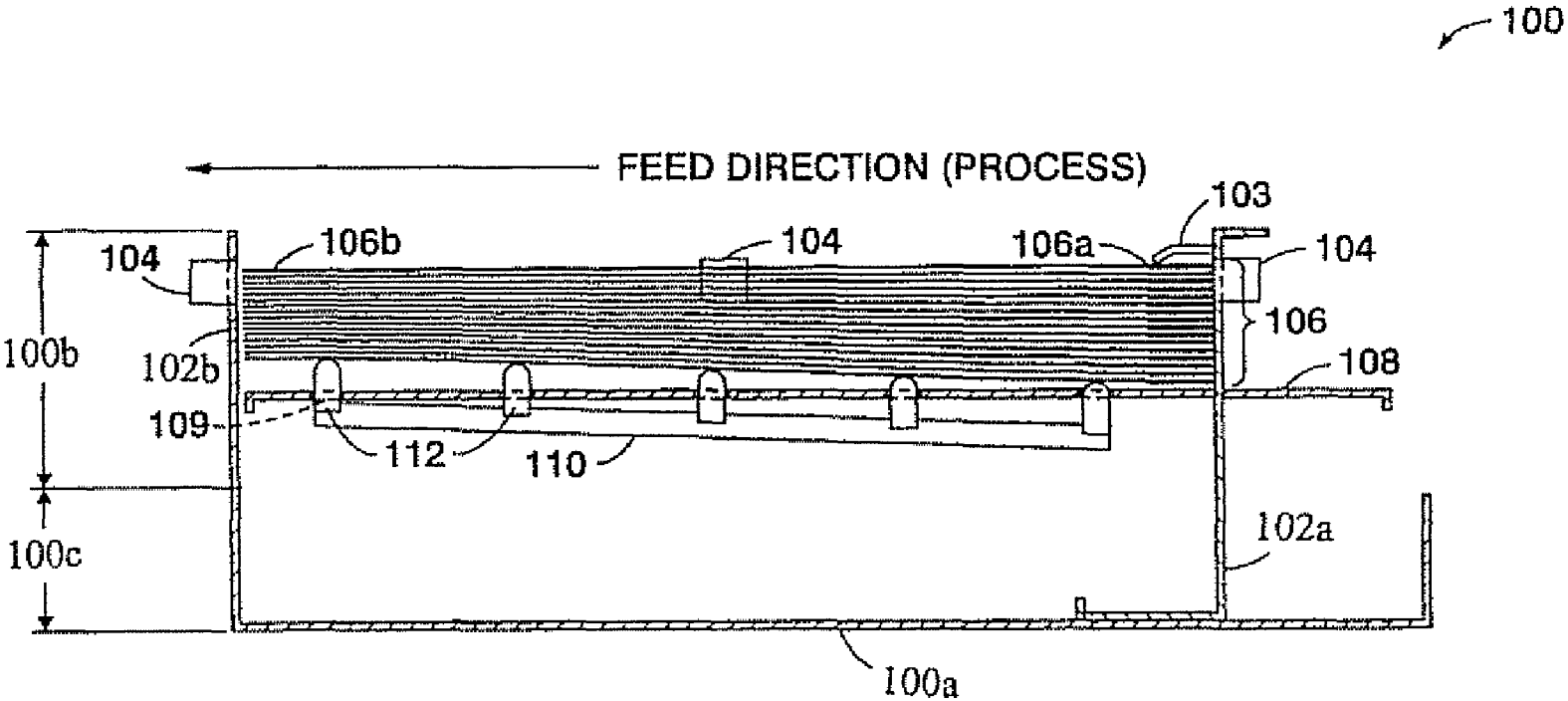
FIG. 2 is a side view of a sheet feed apparatus in a document reproduction machine of an exemplary embodiment.

Referring to FIG. 2, one or more plungers 112 may be actuated, so that at least one sheet 106 is substantially flat. As shown in FIG. 2, one embodiment of a sheet feed apparatus may include a feed box 100 having a bottom 100*a*, an upper portion 100*b*, a lower portion 100*c*, an adjustable trail edge guide 102*a*, a lead edge guide 102*b*, a front edge guide 102*c* (not shown), a rear edge guide 102*d* (not shown) a stack height finger 103, a plurality of sensors 104, a sheet 106 having a trail edge 106*a* and a lead edge 106*b*, front edge 106*c* (not shown), rear edge 106*d* (not shown), an elevator 108, apertures 109 defined by elevator 108, an actuating device 110, a data processing device 111, plungers 112, and a feed device 101. A sheet 106 is substantially flat when the trail edge 106*a*, lead edge 106*b*, front edge 106*c*, and rear edge 106*d* are substantially equal in height from the bottom of the feedbox 100, i.e. Δh equals about zero (accordingly Δh is not shown). The plungers 112 adjust the bottom of the sheet 106 or stack of sheets 106 so as to ensure that the upper most sheet 106 is substantially flat. Thus, the sheet 106 may have a trail edge 106*a*, a lead edge 106*b*, a front edge 106*c*, and a rear edge 106*d* are of equal height, i.e. Δh equals about zero.

Once the sheet 106 is substantially flat, one or more sensors 104 will send this information to the data processing device 111, whereupon the data processing device 111 will send information to the actuating device 109 to stop directing the plungers 112 to act on sheets 106, or to stop moving the plungers. The feed device 101 may then be activated to receive a sheet 106 into the document reproduction machine. In one exemplary embodiment, an electronic communication network enables communication between the sensors 104, data processing device 111, and actuating device 110. The network may include any format of electrical or optical communications, including wireless and wired networks.

As shown in FIG. 2, one or more plungers 112 move at varying times and heights through the apertures 109 of the elevator 108. One or each plunger 112 may be controlled by the actuating device 110. A plurality of plungers 112 may be attached to the actuating device 110. The plungers 112 may interpose the elevator 108 and the bottom of the feed box 100. The plungers 112 may be constructed and arranged to prevent any marks, indentations, or tearing of a sheet 106. The plungers 112 may be of varying shapes. For example, the plunger 112 may be cylindrical shaped, square shaped, rectangular shaped, or irregular shaped. The plunger 112 may be a non-removable part of the actuating system 110. Alternatively, the plunger 112 may be a removable part, and replaceable. A plunger 112 may be attached to the actuator by a sealing process, screw process, welding process or the like. The head (not shown) of the plunger 112 may be spherical in shape, irregular shaped, or even flat shaped. The plunger head may be made of the same material as the plunger 112, or the plunger head may be made of a different material. The plunger head may be a removable and replaceable part of the plunger 112. Aperture 109 in the elevator 108 may be constructed to receive a plunger 112, according to information sent from the sensors 104 to the data processing device 111. A plunger 112 may move vertically or at an angle through the elevator aperture 109. It is not necessary for every plunger 112 to be actuated by the actuating device 110 at the same time.

If the sheet 106 to be fed into the feed device 101 is flat, then the sensors 104 will provide this information to the data processing device 111 passively or actively. The data processing device 111 may then instruct the actuating device 109 to desist from actuating any of the plungers 112. When the feedbox 100 contains no more sheets 106, the elevator 108 may be arranged to move back to its lowest position within the feedbox 100. Also, each plunger 112 may reposition itself so that the head surface of each plunger may reposition themselves, before or after the elevator 108 returns to its lowest position within the feedbox 100.

Figure 3:
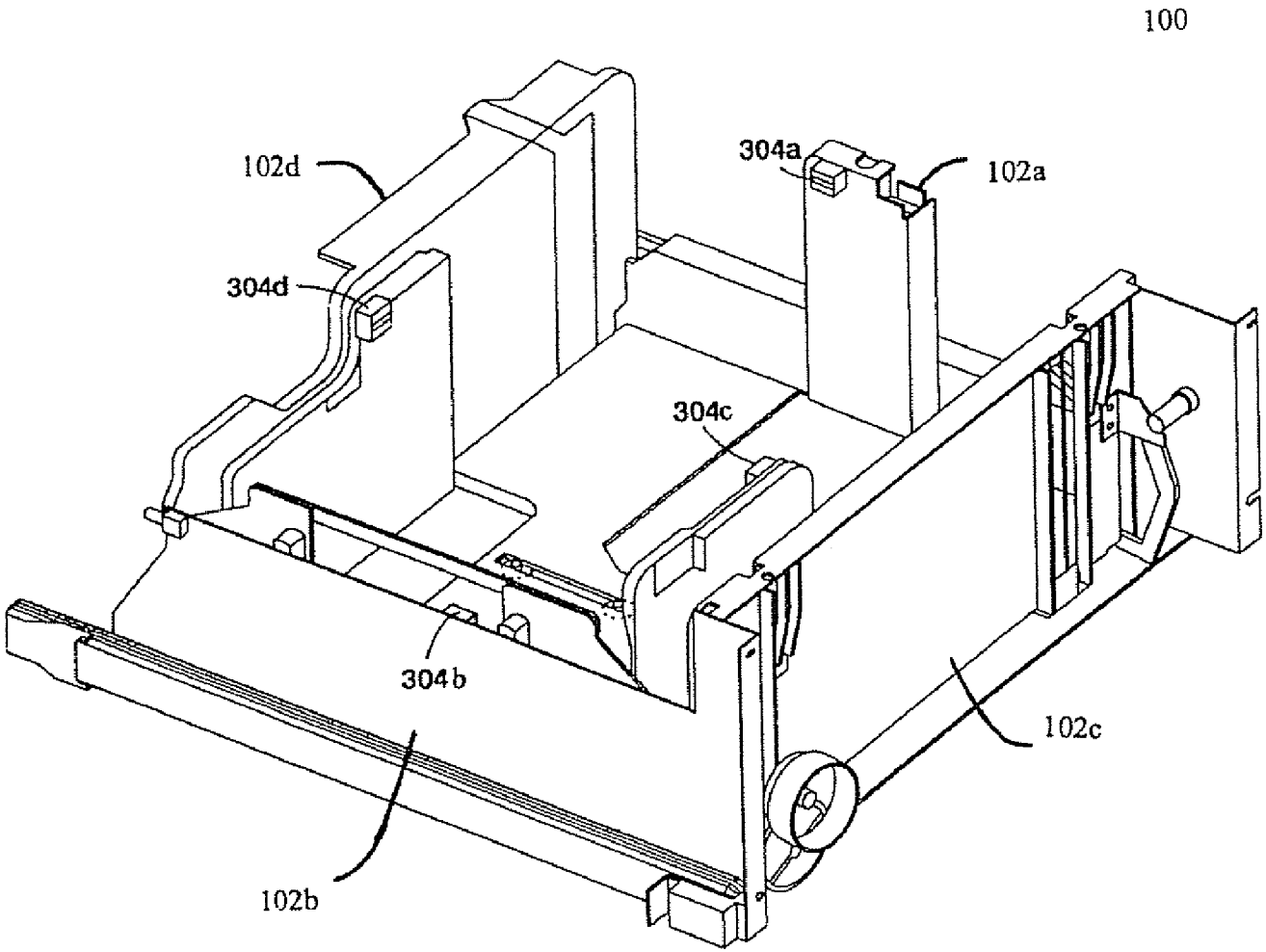
FIG. 3 is a top perspective view of an exemplary feed box of an exemplary embodiment.

FIG. 3 shows a top perspective view of the feed box 100 in accordance with another exemplary embodiment. The feed box 100 has a stack height finger 103 and the sensors 304*a*-304*d*. A sensor 304*a* may be located on the trail edge guide 102*a*, a sensor 304*b* may be located on the lead edge guide 102*b*, a sensor 304*c* may be located on the front edge guide 102*c*, and a sensor 304*d* may be located on the rear edge guide 102*d*. Sensors 304*a*, 304*b*, 304*c* and 304*d* may be located in the upper portion 100*b* of the feed box 100, and on the same plane.

Figure 4:
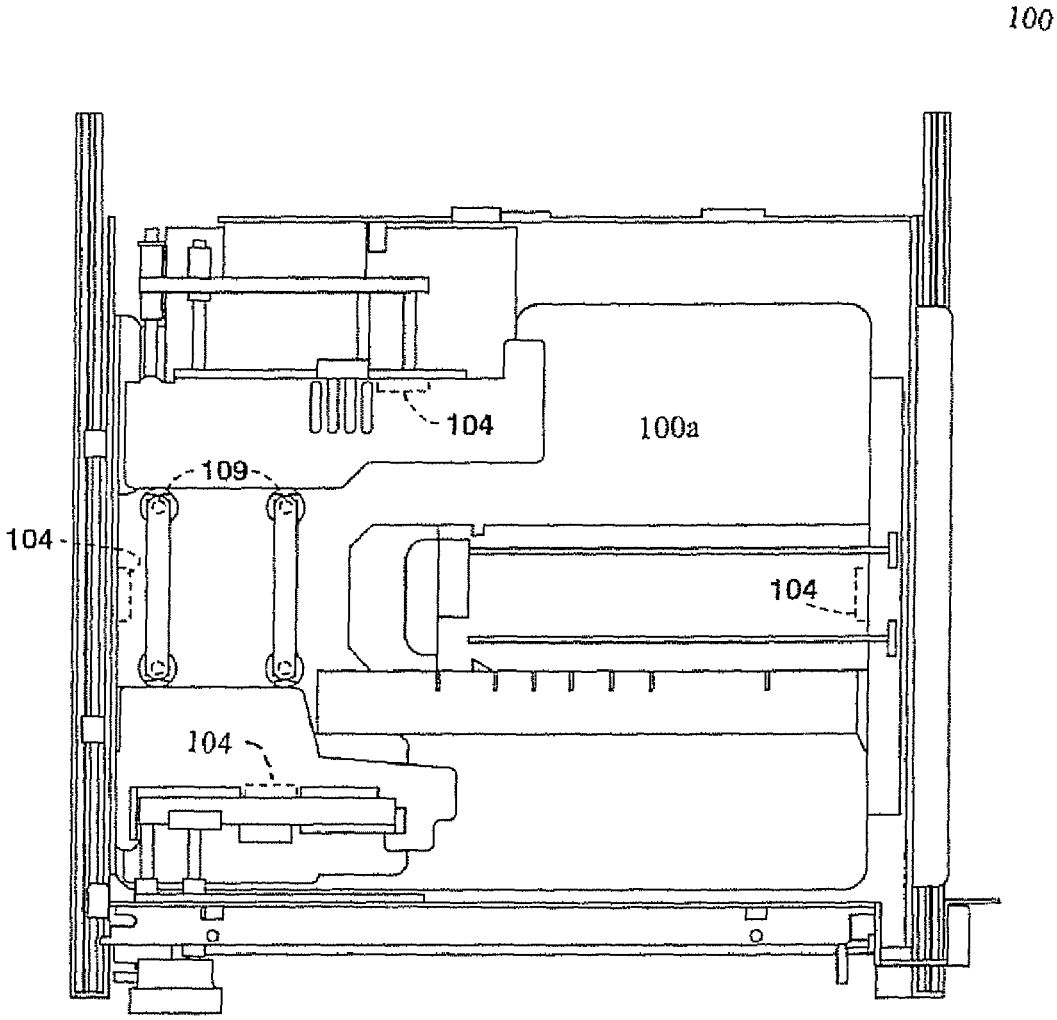
FIG. 4 is a plan view of an exemplary feed box of an exemplary embodiment.

FIG. 4 shows a top view of feed box 100 in accordance with another exemplary embodiment. Elevator 108 may define a plurality of apertures 109. Also, the feedbox 100 may have a plurality of sensors 104, as shown. The feed box 100 has a stack height finger 103 and the sensors 304*a*-304*d*. A sensor 304*a* may be located on the trail edge guide 102*a*, a sensor 304*b* may be located on the lead edge guide 102*b*, a sensor 304*c* may be located on the front edge guide 102*c*, and a sensor 304*d* may be located on the rear guide 102*d*. Sensors 304*a*, 304*b*, 304*c* and 304*d* may be located in the upper portion 100*b* of the feed box 100, and may be located in the same plane.

Figure 5:
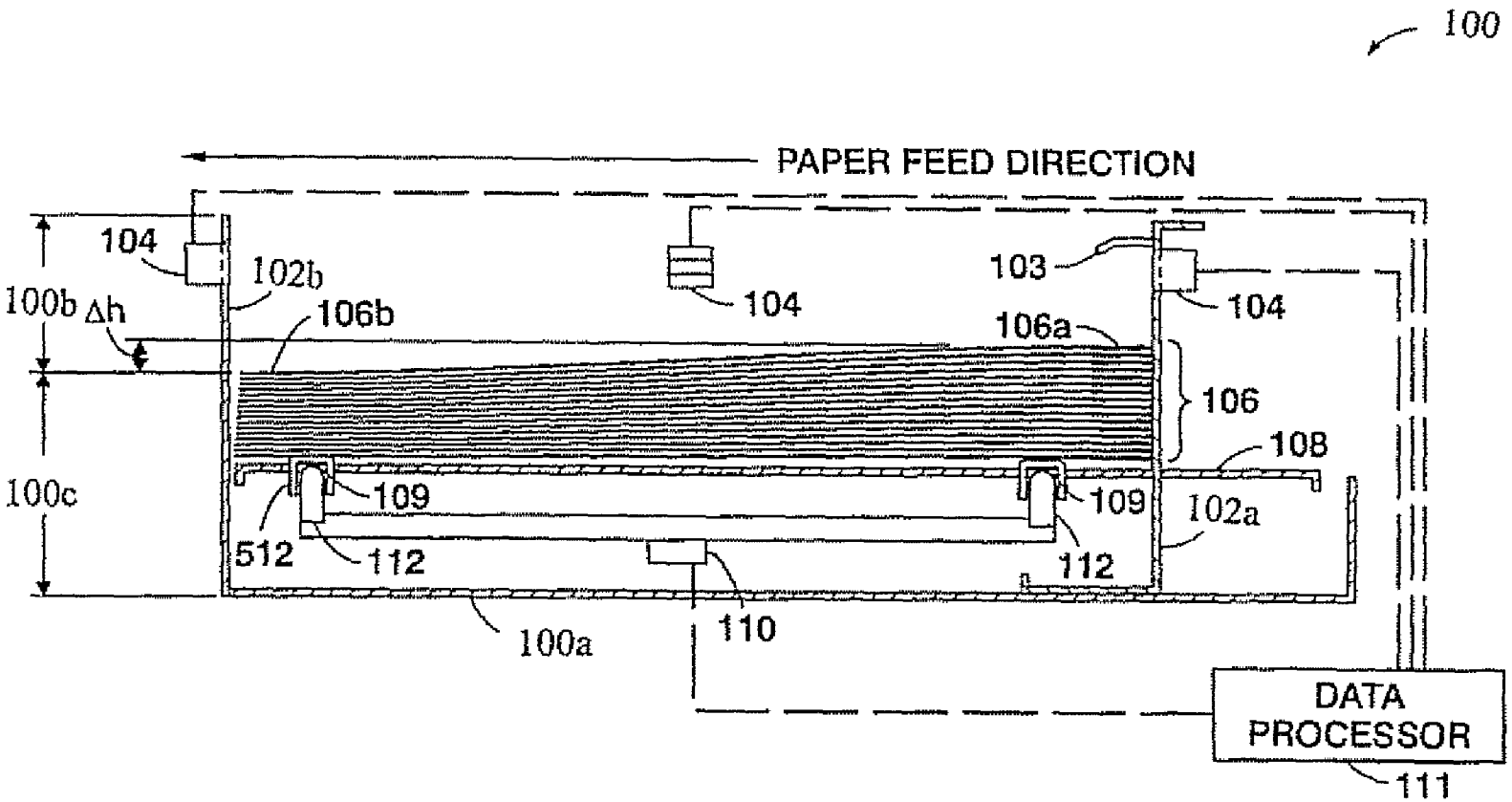
FIG. 5 is a side view of a sheet feed apparatus in a document reproduction machine of an exemplary embodiment.

FIG. 5 shows another exemplary embodiment of a sheet feed apparatus, which may include a feed box 100 having a bottom 100*a*, an upper portion 100*b*, a lower portion 100*c*, an adjustable trail guide 102*a*, a lead edge guide 102*b*, a front edge guide 102*c* (not shown), a rear edge guide 102*d* (not shown), a stack height finger 103, a plurality of sensors 104, a sheet 106 having a trail edge 106*a*, lead edge 106*b*, a front edge 106*c* (not shown), and a rear edge 106*d* (not shown), whereby there may be, due to stacking, a height difference, Δh, between either the trail edge of sheet 106*a*, the lead edge of sheet 106*b*, front edge of sheet 106*c* (not shown), a rear edge of sheet 106*d* (not shown), an elevator 108, apertures 109 defined by elevator 108, an actuating device 110, a data processing device 111, a feed device 101, and plungers 112 that may have a flat upper surface 512. The flat upper surface 512 may be removably attached to plungers 112, or may be defined by plungers 112. Alternatively, flat upper surface 512 may be separate from plungers 112 but irremovably attached thereto. The flat upper surface 512 may be constructed through the apertures 109. The flat upper surface 512 may contact various portions of the sheet via the plungers 112. The flat upper surface 512 may be designed in bracket shape, or other shape that accommodates in applying pressure to a stack of sheets 106 so as to cause the topmost sheet 106 to have a substantially flat surface, thereby causing Δh to equal about zero. The plungers 112 and the flat upper surface 512 may be constructed to function in accordance with embodiments described herein.

Figure 6:
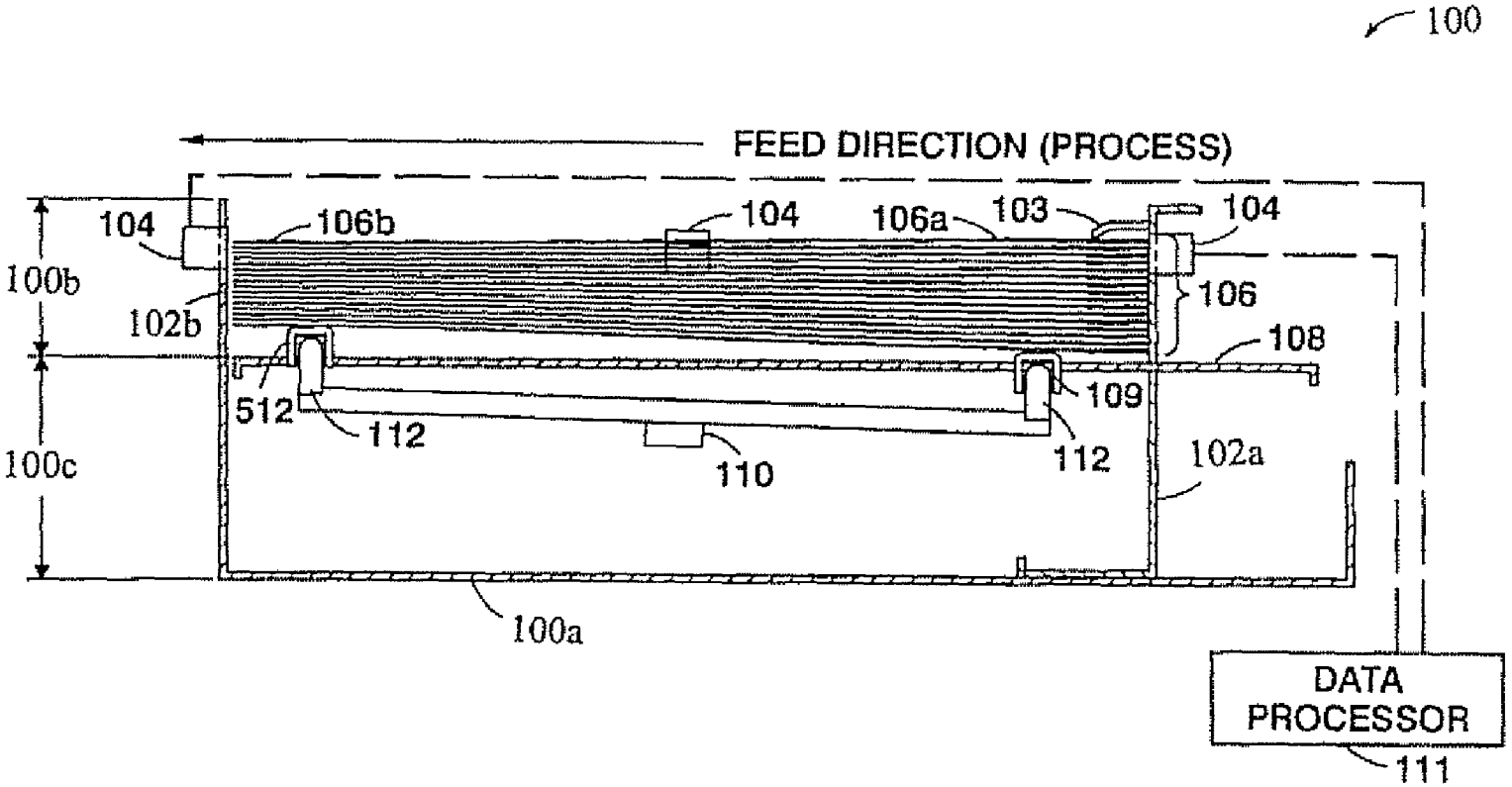
FIG. 6 is a side view of a sheet feed apparatus in a document reproduction machine of an exemplary embodiment.

FIG. 6 shows one or more plungers 112 with a flat upper surface 512 being actuated or following actuation. FIG. 6 shows one embodiment of a sheet feed apparatus that may include a feed box 100 having a bottom 100*a*, an upper portion 100*b*, a lower portion 100*c*, an adjustable trail guide 102*a*, a lead edge guide 102*b*, a front edge guide 102*c* (not shown), a rear edge guide 102*d* (not shown), a stack height finger 103, a plurality of sensors 104, a sheet 106 having a trail edge 106*a*, lead edge 106*b*, a front edge 106*c* (not shown), a rear edge 106*d*, (not shown), an elevator 108, apertures 109 defined by the elevator 108, an actuating device 110, a data processing device 111, a feed device 101 and plungers 112 having a flat upper surface 512. According to an exemplary embodiment, as each plunger 112 is actuated, the flat upper surface 512 of one or more plungers 112 contact and move one or more portions of the sheet 106. As shown in FIG. 6, the stack of sheets 106 has been moved so as to allow the trail edge 106*a*, lead edge 106*b*, front edge 106*c* (not shown), and rear edge 106*d* (not shown) to have equal height, i.e. Δh equals about zero.

Figure 7:
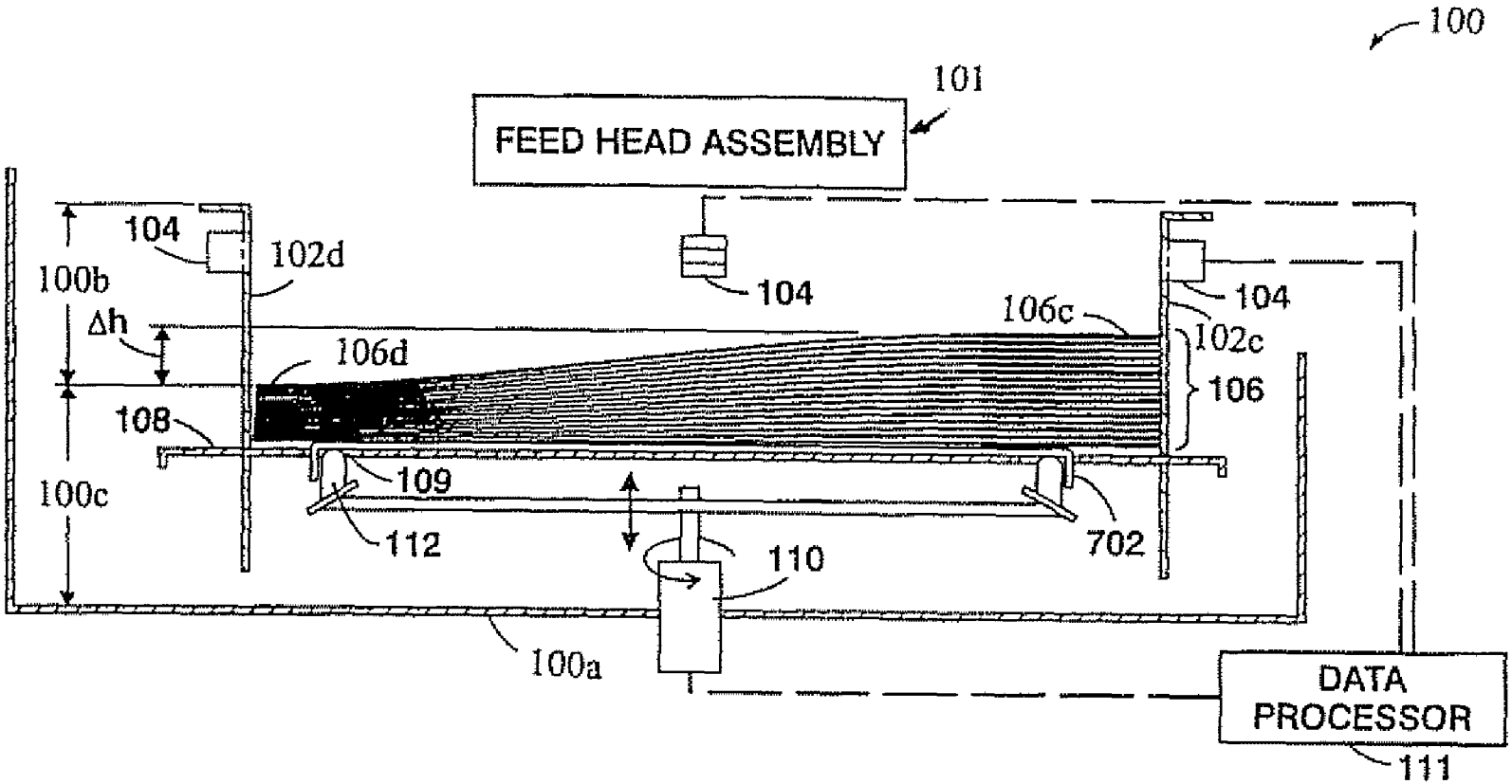
FIG. 7 is an end view of a sheet feed apparatus in a document reproduction machine of an exemplary embodiment.

FIG. 7 shows yet another exemplary embodiment of a sheet feed apparatus, which may include a feed box 100 having a bottom 100*a*, an upper portion 100*b*, a lower portion 100*c*, an adjustable trail guide 102*a* (not shown), a lead edge guide 102*b* (not shown), a front edge guide 102*c*, a rear edge guide 102*d*, a stack height finger 103, a plurality of sensors 104, a sheet 106 having a trail edge 106*a* (not shown), a lead edge 106*b* (not shown), a front edge of sheet 106*c*, a rear edge of sheet 106*d*, whereby there may be due to stacking, a height difference, Δh, between either the trail edge 106*a*, the lead edge 106*b*, and/or the front edge 106*c*, the rear edge 106*d*, an elevator 108, apertures 109 defined by elevator 108, an actuating device 110, a data processing device 111, a feed device 101, and plungers 112 that may have a plate 702 attached to plunger 112. The plungers 112 may act indirectly on sheets 106. The top of the plungers 112 may be attached to a plate 702. The plate 702 may be a singular plate that is in parallel with the elevator tray, or the plate 702 can be a plurality of separate plates that are connected in series and are also in parallel with the elevator 109. The plate 702 may be constructed from a variety of different materials, such as metal, plastic or any other suitable material. The plate 702 may alternatively be a rod or any other support means now known or later developed. FIG. 7 shows the plungers 112 not being actuated by the actuating device 110. The sheets 106 has a height difference, Δh, between either the trail edge 106*a* (not shown), the lead edge 100*b* (not shown), the front edge of sheet 106*c*, the rear edge 106*d*, and the top-most sheet 106 is not substantially flat.

Figure 8:
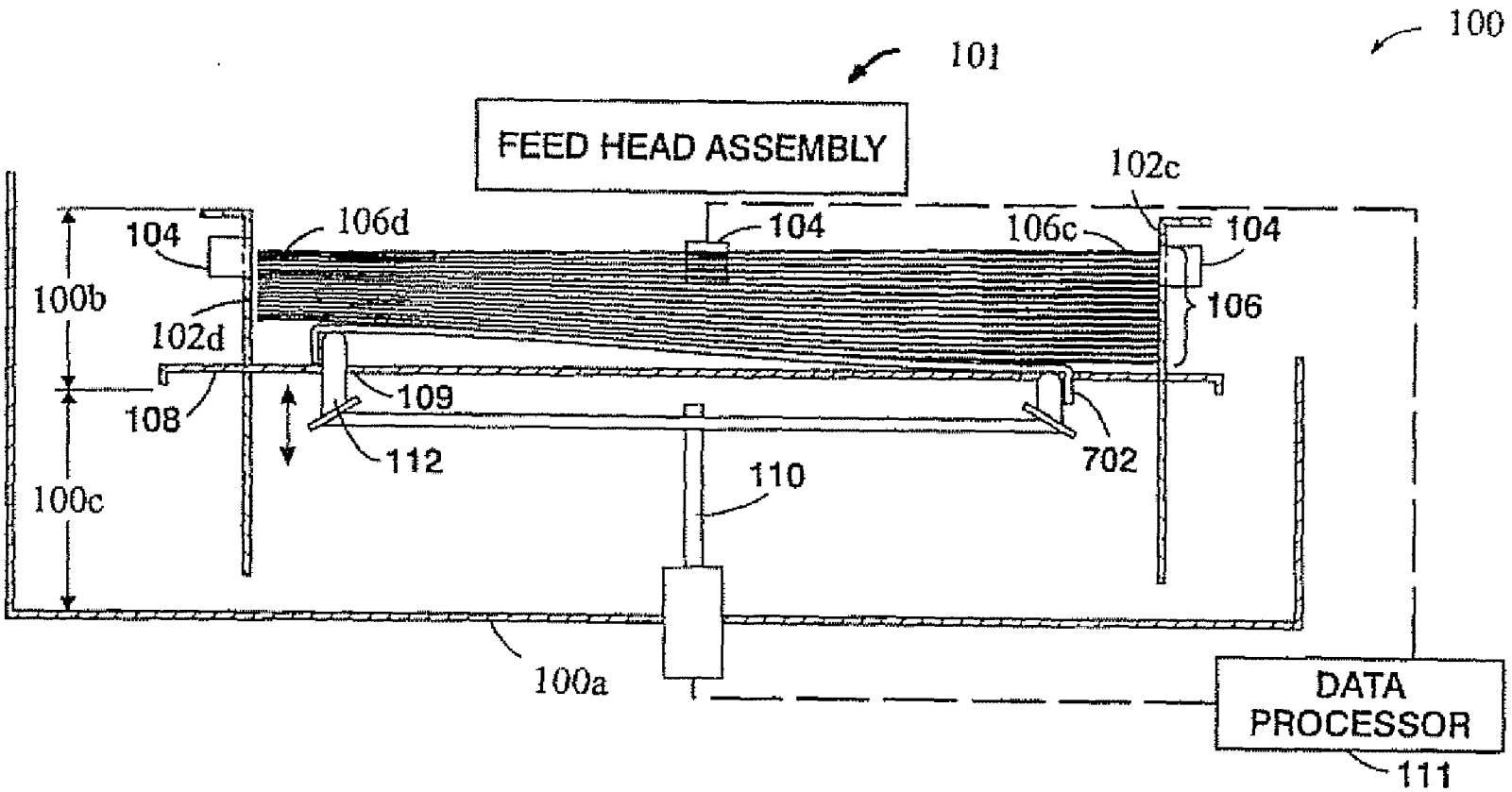
FIG. 8 is an end view of a sheet feed apparatus in a document reproduction machine of an exemplary embodiment.

FIG. 8 shows a sheet feed apparatus, which may include a feed box 100 having a bottom 100*a*, an upper portion 100*b*, a lower portion 100*c*, an adjustable trail guide 102*a* (not shown), a lead edge guide 102*b* (not shown), a front edge guide 102*c*, a rear edge guide 102*d*, a stack height finger 103, a plurality of sensors 104, a sheet 106 having a trail edge 106*a* (not shown), a lead edge 106*b* (not shown), a front edge of sheet 106*c*, a rear edge of sheet 106*d*, an elevator 108, apertures 109 defined by elevator 108, an actuating device 110, a data processing device 111. The plungers 112 are actuated by the actuating device 110. By actuating the plungers 112, the plate 702, attached thereto, may cause the trail edge 100*a* (not shown), a lead edge 106*b* (not shown), a front edge 106*c*, and the rear edge 106*d* to be of equal height, i.e. Δh equals about zero. As shown in FIG. 8, the sheet 106 is substantially flat and ready for being fed into the feed device 101.

Figure 9:
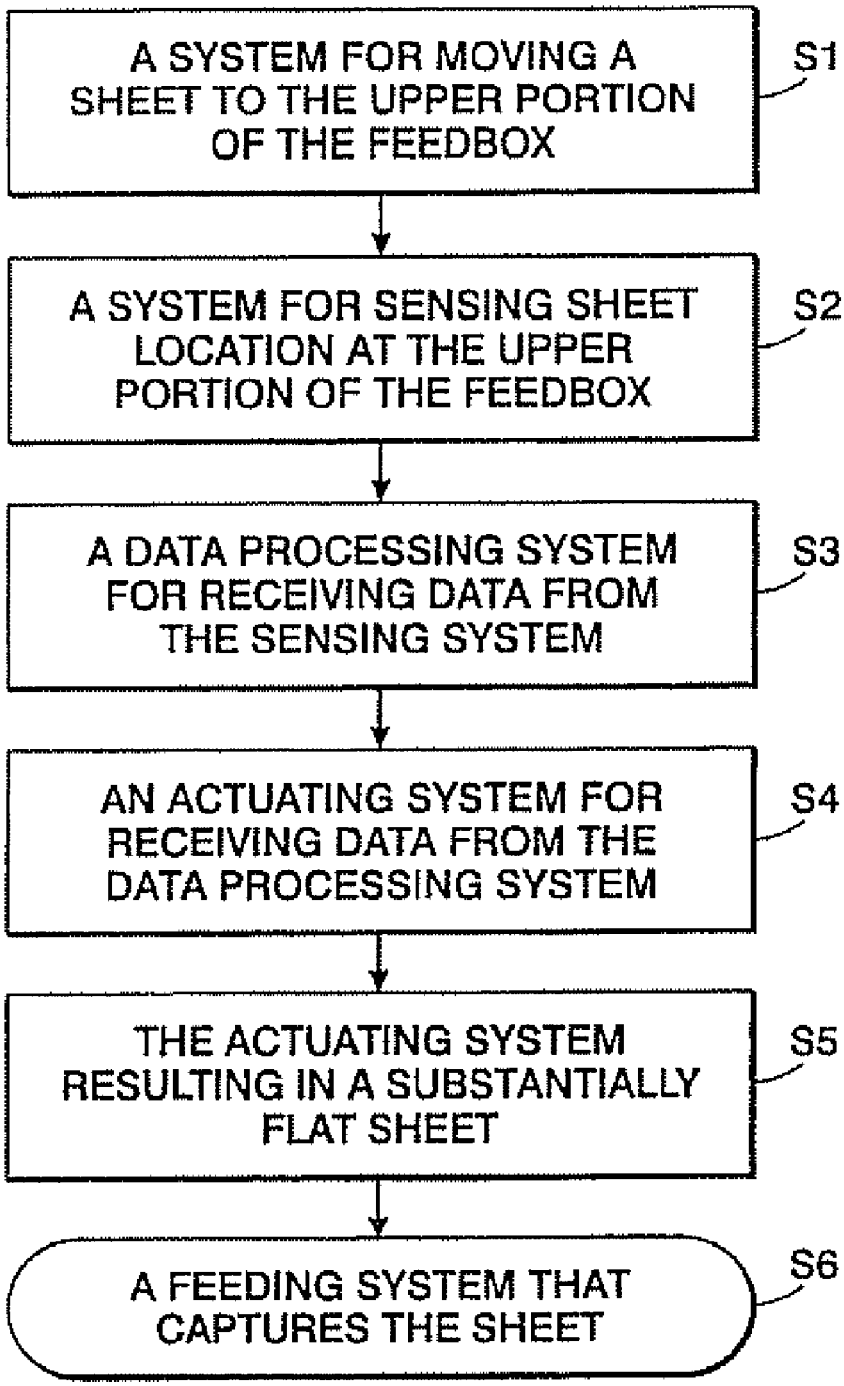
FIG. 9 is a flow chart describing a system for feeding a sheet in a document reproduction machine of an exemplary embodiment.

FIG. 9 shows a system for feeding a sheet in a document reproduction system. In Step 1, a system is used to carry a sheet vertically in the feed box, so that the sheet reaches an upper portion of the feedbox. The system may use any elevator mechanism that may be driven by a computer readable program, a computer system, a mechanical, an electrical system, or an electromechanical system.

In FIG. 9, Step 2, a system for sensing sheet location may be located at the upper portion of the feedbox. The system for sensing sheet location may include a plurality of sensor or other devices for sensing a sheet. The system for sensing sheet location may include a optical system that may include photodetectors, semiconductor devices such as photocells, photodiodes, photo-transistors, LCD's and image sensors. The system of sensing sheet location may include a laser system. In Step 3, the sensing system sends information on sheet location to a data processing system. The data processing system may include sub-systems for input, processing, storage and output. The data processing system sends information to an actuating system in Step 4. The actuating system may be driven by a mechanical system, computer system, electrical system, or electromechanical system. The actuating system may include a cam system, a step motor system, an elevator system, a pneumatic system, a hydraulic system. The data processing system may be a part of the actuating system. In Step 5, the actuating system may cause a sheet to become substantially flat. In Step 6, the sheet is fed into a feeding system. The feeding system may be a vacuum system, a roller-retard system, or any other electromechanical, mechanical, or electrical system that can capture a sheet.

For purposes of explanation and the above description, numerous specific details were set forth in order to provide a thorough understanding of a sheet feed apparatus contained in a document reproduction machine. It will be apparent, however, to one skilled in the art that feeding a sheet as described above can be practiced without the specific details. In other instances, well known structures and devices are shown in block diagram form in order to avoid obscuring the apparatus described.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A sheet feed apparatus for a document reproduction machine, comprising:

a feed device constructed to receive a sheet;

a feedbox having an upper portion and a lower portion, a bottom located in the lower portion, and the feed device located at the upper portion of the feedbox;

a plurality of plungers located at the lower portion;

a vertically adjustable elevator, positioned within the feedbox, and constructed to carry the sheet;

a plurality of sensors situated at an upper portion of the feedbox wherein the sensors are activated by a portion of the sheet;

a data processing device that receives information from the plurality of sensors; and a single actuating device located below the plurality of plungers, and connected to the plurality of plungers, constructed to receive information from the data processing device, wherein:

the plurality of sensors comprises at least four sensors located at positions corresponding to at least four different edges of the sheet;

the four sensors are configured to measure a height of the sheet at the corresponding edge of the sheet;

each one of the plurality of plungers contacts a different portion of the sheet;

the plurality of plungers are constructed to independently adjust the height of the sheet where the plurality of plungers contacts the portion of the sheet; and each plunger of the plurality of plungers adjusts the height of the corresponding portion of the sheet until the four sensors measure the height of the sheet to be the same at each sensor.

2. The sheet feed apparatus of claim 1, wherein the feedbox comprises an adjustable side.

3. The sheet feed apparatus of claim 1, wherein the sensors are optical.

4. The sheet feed apparatus of claim 1, wherein the plungers comprise a head that is parallel to the bottom.

5. The sheet feed apparatus of claim 1, wherein the feed device defines an opening situated on a plane parallel to the bottom, and the sensors are positioned on a plane parallel to the opening.

6. The sheet feed apparatus of claim 1, further comprising a plate connected to at least one of the plurality of plungers wherein the plate is arranged on a plane substantially parallel to the bottom, and wherein the plate is constructed and arranged to be actuated by at least one of the plurality of plungers to move a portion of the sheet, thereby causing the sheet to be fed into the feed device in a substantially flat state.

7. The sheet feed apparatus of claim 4, wherein the plunger head is adjustable.

8. The sheet feed apparatus of claim 1, wherein the apertures are adjustable.

9. The sheet feed apparatus of claim 1, wherein the plurality of plungers are variably angled.

10. The sheet feed apparatus of claim 1, wherein the plungers further comprise a detachable head.

11. The sheet feed apparatus of claim 1, wherein the plungers further comprise a head that is irregularly shaped.

12. The sheet feed apparatus of claim 1, wherein the elevator further comprises a plurality of apertures that are capable of receiving the plungers.

13. A method for feeding sheets in a document reproduction device, comprising:

moving vertically an elevator that contains a sheet inside a feedbox;

sensing at least one sheet, by using at least four sensors located at positions in the feedbox that correspond to four different edges of the sheet;

sending information from the sensors to a data processing device;

processing the information in the data processing device;

sending processed information to a single actuating device, the actuating device being connected to a plurality of plungers; and actuating the actuating device to move the plurality of plungers, the plurality of plungers being configured to move independently to cause at least one sheet to be situated substantially in parallel to the bottom of the feedbox, whereby feeding the substantially in parallel sheet to the feed device located above the feedbox is accommodated.

14. The method of claim 13, wherein the data processing device is connected to the actuating device.

15. The method of claim 13, wherein the plungers move through apertures of the elevator.

16. A system for feeding sheets in a document reproduction device, comprising:

an elevator system whereby at least one sheet is carried vertically to an upper portion of a feedbox system;

a system for sensing sheet position comprising a plurality of sensors at the upper portion of the feedbox;

a data processing system for receiving and processing data from the system for sensing sheet location; and an actuating system for receiving data from the data processing system, whereby the actuating system causes a sheet to be substantially flat;

the actuating system comprises a single actuating device connected to a plurality of plungers;

a feeding system captures and receives the substantially flat sheet;

the plurality of sensors comprises at least four sensors located at positions corresponding to at least four different edges of the sheet;

the four sensors are configured to measure a height of the sheet at the corresponding edge of the sheet;

each one of the plurality of plungers contacts a portion of the sheet;

the plurality of plungers are constructed to independently adjust the height of the sheet where the plurality of plungers contacts the portion of the sheet; and the plurality of plungers adjusts the height of the corresponding portion of the sheet until the four sensors measure the height of the sheet to be the same at each sensor.

* * * * *